US007934965B2

(12) United States Patent
Hanai et al.

(10) Patent No.: US 7,934,965 B2
(45) Date of Patent: May 3, 2011

(54) EXHAUST SYSTEM FOR SMALL WATERCRAFT

(75) Inventors: Toshinori Hanai, Saitama (JP); Hajime Shogase, Saitama (JP); Masatsugu Matsumoto, Saitama (JP); Junji Higashiyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 64 days.

(21) Appl. No.: 12/393,636

(22) Filed: Feb. 26, 2009

(65) Prior Publication Data

US 2009/0233501 A1 Sep. 17, 2009

(30) Foreign Application Priority Data

Mar. 17, 2008 (JP) ..... 2008-068027

(51) Int. Cl.
*B63H 21/34* (2006.01)

(52) U.S. Cl. ..... 440/89 G; 440/89 J

(58) Field of Classification Search ..... 440/89 G, 440/89 J, 89 R

See application file for complete search history.

(56) References Cited

U.S. PATENT DOCUMENTS

| | | | | |
|---|---|---|---|---|
| 5,879,211 | A * | 3/1999 | Koyanagi | 440/89 R |
| 6,679,742 | B2 * | 1/2004 | Yokoya et al. | 440/89 J |
| 6,800,005 | B2 * | 10/2004 | Yokoya | 440/89 R |
| 7,056,174 | B2 * | 6/2006 | Yokoya et al. | 440/89 J |
| 7,156,710 | B2 * | 1/2007 | Yokoya et al. | 440/89 J |

FOREIGN PATENT DOCUMENTS

JP 2003-54493 A 2/2003

* cited by examiner

*Primary Examiner* — Lars A Olson

(74) *Attorney, Agent, or Firm* — Birch, Stewart, Kolasch & Birch, LLP

(57) ABSTRACT

An exhaust system for a small watercraft for effectively reducing exhaust noise and allowing a high output of an engine to be easily obtained at the time of high speed operation. An exhaust outlet of an exhaust pipe extending from an engine provided in a watercraft body is disposed at a position that allows it to sink in the water at the time when a travel speed of the watercraft body is a predetermined speed or less. The exhaust outlet is raised above the water at the time when the travel speed of the watercraft body exceeds the predetermined speed. An open surface of the exhaust outlet is offset toward a side wall surface of a pump chamber from a center of a jet pump in the pump chamber and is made oblique toward the side wall surface toward which the open surface of the exhaust outlet is offset.

9 Claims, 6 Drawing Sheets

63
63a
63b
63c
63d
W1
62
64b
54b
65c
65
65b
65a
90
60
54
54'
G,W
61
71
b
53'
53
64
64a

EXHAUST SYSTEM FOR SMALL WATERCRAFT

CROSS-REFERENCE TO RELATED APPLICATIONS

The present application claims priority under 35 USC 119 to Japanese Patent Application No. 2008-068027 filed on Mar. 17, 2008 the entire contents of which are hereby incorporated by reference.

BACKGROUND OF THE INVENTION

1. Field of the Invention

The present invention relates an exhaust system for a small watercraft.

2. Description of Background Art

An exhaust system for a small watercraft is known wherein a system includes a resonator (40) that is provided in an exhaust outlet of an exhaust pipe extending from an engine provided in a watercraft body. See, for example, JP-A No. 2003-054493.

According to the exhaust system constructed as described above, exhaust noise can be reduced by the resonator. However, even though the exhaust noise can be reduced, at the time when the small watercraft (viz., watercraft body) travels at high speed, the resonator becomes exhaust resistance and contributes to lowering of output of the engine.

SUMMARY AND OBJECTS OF THE INVENTION

The object of an embodiment of the present invention is to address the above-mentioned problem and provide an exhaust system for a small watercraft, which can effectively reduce exhaust noise and, at the same time, allows high output of an engine to be easily obtained at the time of high speed traveling.

In order to attain the object, according to an embodiment of the present invention, there is provided an exhaust system for a small watercraft wherein the watercraft includes a watercraft body, an engine provided in the watercraft body, a pump chamber provided at a center of a rear section of the watercraft body, and a jet pump to be driven by the engine and arranged in the pump chamber. The exhaust system includes a water muffler arranged on one side of the pump chamber, an exhaust pipe extending from the engine and connected through the water muffler to the pump chamber, and an exhaust pipe extending upwardly from the water muffler, bent into a U-shape so as to extend downwardly, and penetrates through an upper wall of the pump chamber in such a manner that an exhaust outlet thereof opens into the pump chamber. A resonator, independent of the exhaust pipes, is connected to the water muffler. The exhaust outlet of the exhaust pipe is disposed at a position that allows the exhaust outlet to sink in the water at the time when a travel speed of the watercraft is a predetermined speed or less. In addition, the exhaust outlet can be out of the water at the time when the travel speed of the watercraft exceeds the predetermined speed.

Moreover, according to the present invention, there is provided an exhaust system for a small watercraft wherein the small water craft includes a watercraft body and an engine provided in the watercraft body. The exhaust system includes an exhaust pipe extending from the engine with an exhaust outlet disposed in a position that allows it to sink in the water at the time when a travel speed of the watercraft body is 2,000 rpm or less in number of revolutions of the engine. In addition, the exhaust outlet can be out of the water at the time when the travel speed of the watercraft body becomes a speed which exceeds 2,000 rpm in the number of revolutions of the engine.

Desirably, the exhaust outlet is directly opened without via the resonator.

Further desirably, an open surface of the exhaust outlet is made oblique with respect to a level surface.

Still desirably, the exhaust outlet, as viewed from the rear of the watercraft body, is provided so as to be offset toward a side wall surface of the pump chamber from a center of the jet pump in the pump chamber, and the open surface of the exhaust outlet is made oblique toward the side wall surface to which the exhaust outlet is offset.

The water muffler is formed into a cylindrical shape and is arranged laterally along the pump chamber, with a longitudinal direction thereof being oriented in a forward/rearward direction, and the resonator is also formed into a cylindrical shape and arranged outward laterally along the water muffler.

According to the exhaust system for the small watercraft, which is constructed as discussed above, the following operation and effect are obtained. In general, when the number of revolutions of the engine is low in a small watercraft, the exhaust noise is not pleasant for the passengers of the watercraft.

According to an embodiment of the present invention, exhaust noise in the low frequency region is reduced by the resonator independent of the exhaust pipes and, at the same time, a muffling effect is obtained since the exhaust outlet of the exhaust pipe extending from the engine provided in the watercraft body sinks into the water when the travel speed of the watercraft body is the predetermined speed or less (namely, at the time when the number of revolutions of the engine is low).

Therefore, according to an embodiment of the present invention, unpleasant exhaust noise in the low frequency region can be effectively reduced by the synergistic effect of the effect of reduction in exhaust noise in the low frequency region by the resonator and the muffling effect due to the sinking of the exhaust outlet of the exhaust pipe in the water.

On the other hand, when the travel speed of the watercraft body exceeds the predetermined speed, the exhaust outlet is out of the water.

Thereby, exhaust resistance due to the sinking of the exhaust outlet in the water vanishes and a condition where high output of the engine is easy to be obtained is brought about.

As discussed above, according to an embodiment of the present invention, the exhaust noise can be effectively reduced and, at the same time, the high output of the engine at the time of high speed traveling becomes easy to be obtained.

More particularly, the exhaust outlet of the exhaust pipe is arranged at a position that allows it to sink in the water at the time when the travel speed of the watercraft body is 2,000 rpm or less in number of revolutions of the engine, and that allows it to get out of the water at the time when the travel speed of the watercraft body becomes a speed which exceeds 2,000 rpm in the number of revolutions of the engine, whereby exhaust noise at the time when the number of revolutions of the engine is 2,000 rpm or less can be effectively reduced and, at the same time, the high output of the engine at the time of the high speed traveling at the time when the number of revolutions of the engine exceeds 2,000 rpm is easy to be obtained.

Moreover, the exhaust outlet opens directly, without via the resonator, into the pump chamber in which the jet pump driven by the engine is arranged, so that the above-mentioned operation and effect become to be further positively obtained.

That is, the pump chamber in which the jet pump is arranged is easy to be stable relative to the water level (hard to be affected by wind and waves at the time of traveling of the watercraft body), as compared to other sections of the watercraft body (for example, the side surfaces and rear surface of the watercraft body).

Therefore, by causing the exhaust outlet to be located in the pump chamber, the above-mentioned operation and effect become to be further positively obtained.

If the open surface of the exhaust outlet is made oblique with respect to the level surface, the sudden lifting of the entire open surface of the exhaust outlet out of the water and the sudden sinking of the entire open surface into the water can be mitigated.

Therefore, the sudden change of the exhaust noise and output of the engine can be mitigated.

Moreover, the exhaust outlet, as viewed from the rear of the watercraft body, is provided so as to be offset toward the side wall surface of the pump chamber from the center of the jet pump in the pump chamber and the open surface of the exhaust outlet is made oblique toward the side wall surface toward which the open surface of the exhaust outlet is offset, whereby exhaust gas mixed with the water from the exhaust outlet can be smoothly discharged along the side wall of the pump chamber.

Moreover, the water muffler is formed into a cylindrical shape and arranged laterally along the pump chamber, in which the jet pump driven by the engine is arranged, with the longitudinal direction thereof being oriented in the forward/rearward direction, and the resonator is also formed into a cylindrical shape and arranged outwardly and laterally along the water muffler, whereby a dead space which is easy to be produced outwardly and laterally of the water muffler in the watercraft body can be advantageously used.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3(*b*) is a side view (a front view of FIG. 3(*a*));

FIG. 3(*c*) is a partially abbreviated rear view;

FIG. 4(*b*) is a side view;

FIG. 4(*c*) is a sectional view taken along c-c line in FIG. 4(*b*);

FIG. 5(*b*) is a partially abbreviated sectional view taken along b-b line in FIG. 5(*a*);

FIG. 6(*b*) is a partially abbreviated side view.

DETAILED DESCRIPTION OF THE PREFERRED EMBODIMENTS

An embodiment of an exhaust system for a small watercraft according to the present invention will be explained hereinafter with reference to the drawings.

Figure 1:
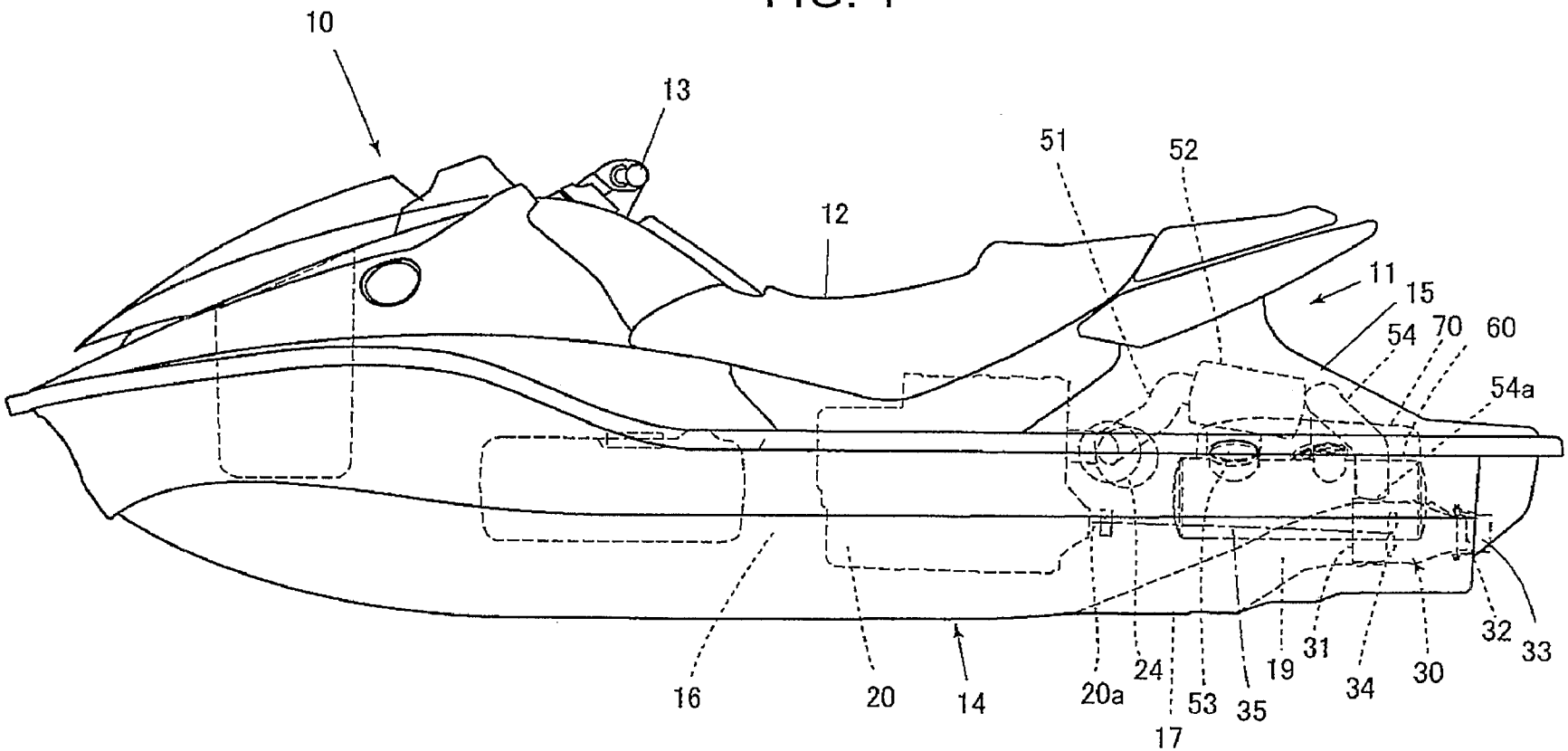
FIG. 1 is a schematic side view illustrating an example of a small watercraft in which an embodiment of an exhaust system for the small watercraft according to the present invention is employed.
Figure 2:
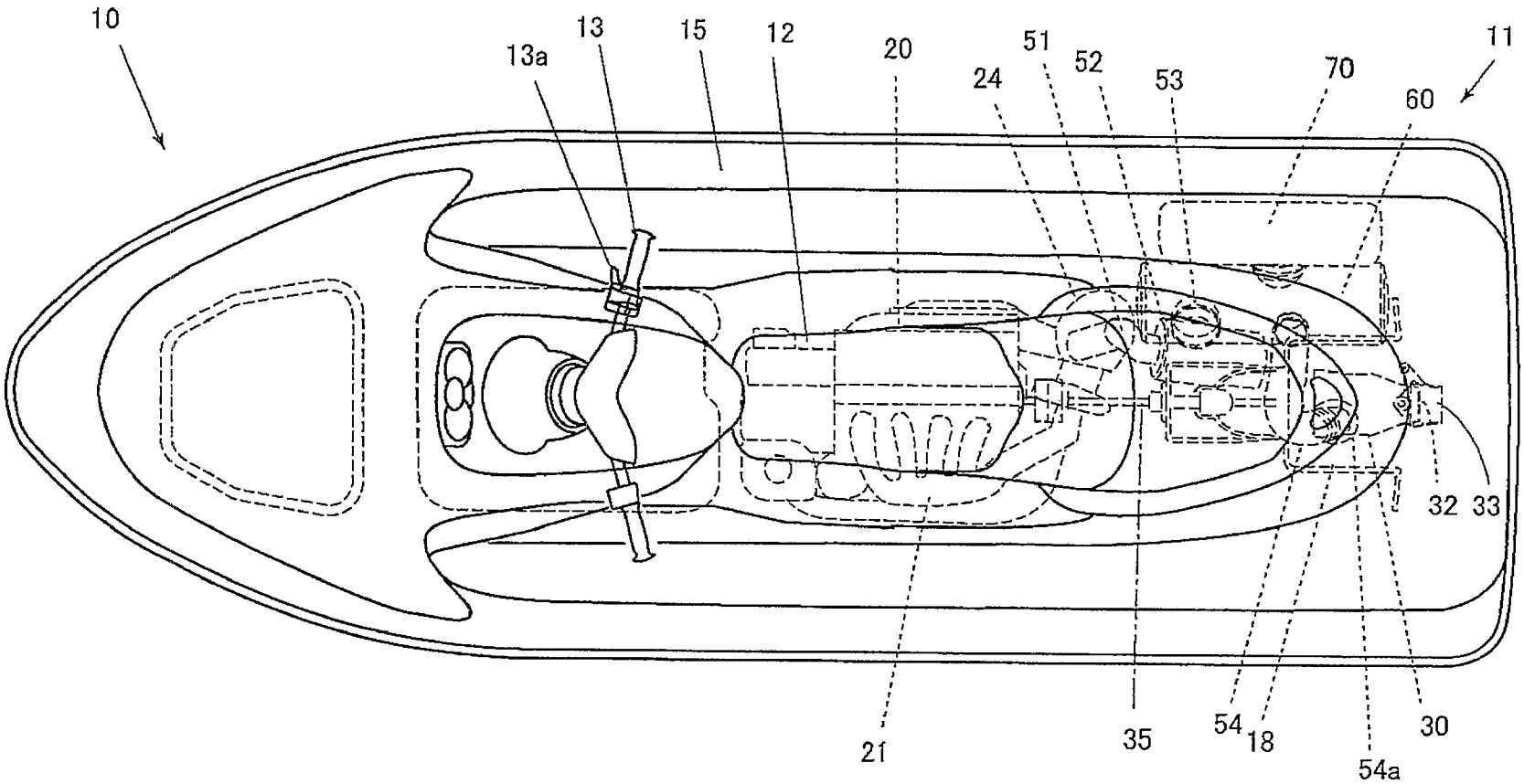
FIG. 2 is a schematic plane view of the small watercraft.

FIG. 1 is a schematic side view showing an example of a small watercraft employing the embodiment of the exhaust system for the small watercraft according to the present invention, and FIG. 2 is a schematic plane view of the small watercraft.

As shown in FIGS. 1 and 2, the small watercraft 10 is a saddle-ridge type small watercraft. An occupant sits on a seat 12 on a watercraft body 11 and grips a steering handlebar 13 provided with a throttle lever 13*a* to operate the small watercraft 10.

The watercraft body 11 has a floating body structure in an interior of which a space 16 is formed by joining a hull 14 and a deck 15 together. In the space 16, an engine 20 is carried on the hull 14 and a jet pump (jet propelling pump) 30 which serves as a propelling means driven by the engine 20 is provided at a rear portion of the hull 14.

Figure 3A:
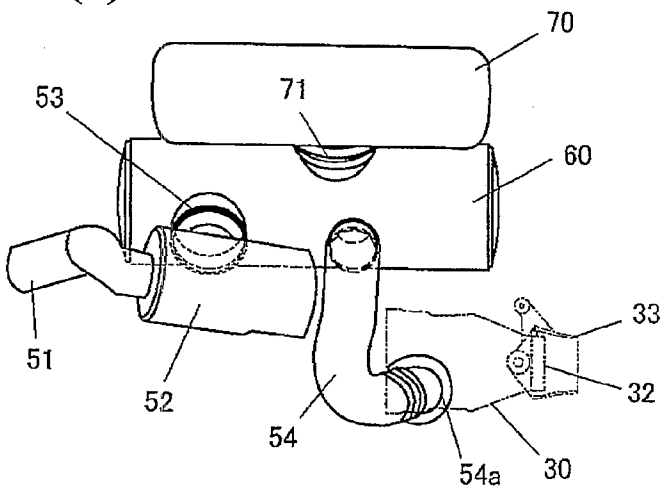
FIG. 3(*a*) is a view illustrating an exhaust system in a plane view.
Figure 3B:
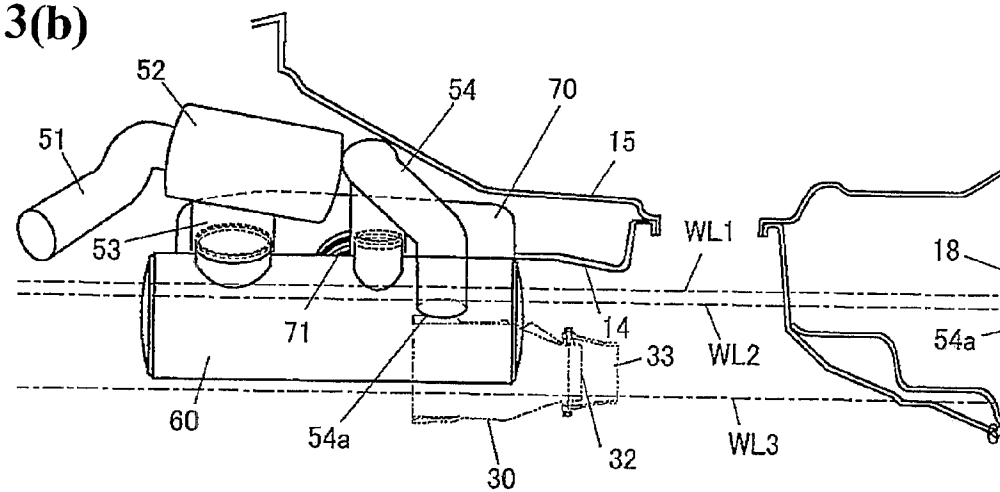
Figure 3C:
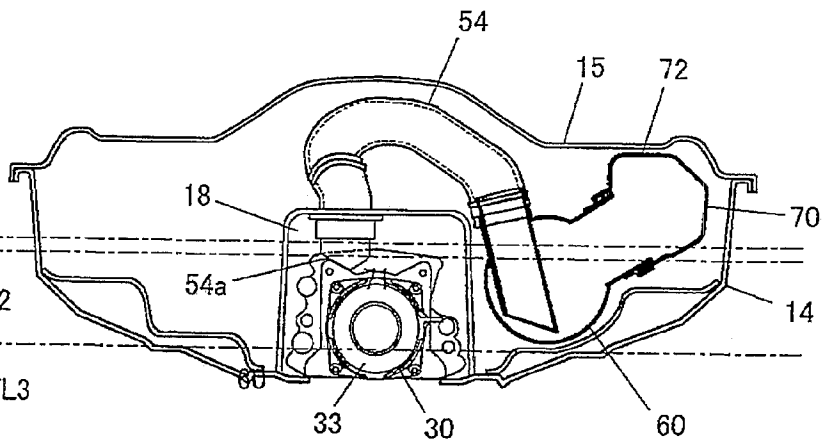

At the rear portion of the hull 14, a water path 19 which extends to a pump chamber 18 (refer to FIGS. 2 and 3(*c*)) from a water intake port 17 that is opened at a bottom of the watercraft is provided. In the pump chamber 18, the jet pump 30 is provided that communicates with the water path 19.

The jet pump 30 has an opening 31 communicating with the water path 19, a jet stream port 32 and a nozzle 33 which allow water to be jetted rearwardly of the watercraft body 11. An impeller 34 is provided in a water path which extends from the opening 31 to the jet stream port 32. A shaft 35 of the impeller 34 is connected to an output shaft 20*a* of the engine 20. Therefore, when the impeller 34 is rotation-driven by the engine 20, water introduced from the water intake port 17 flows through the jet stream port 32 and is jetted from the nozzle 33, whereby the watercraft body 11 is propelled. The number of drive revolutions of the engine 20, viz., propulsive power by the jet pump 30 is controlled by pivotal movement operation of the throttle lever 13*a*. The nozzle 33 is coupled to the steering handlebar 13 through an unshown wire and pivotal movement-operated by operation of the steering handlebar 13, whereby a course of the watercraft body 11 can be changed.

The engine 20 is a DOHC type, in-line four-cylinder, dry sump type four-cycle engine, a crankshaft (output shaft) 20*a* of which is disposed so as to extend along a forward/rearward direction of the watercraft body 11.

A turbo-charger 24 is arranged rearward of the engine 20. An exhaust outlet of an engine exhaust manifold 21 is connected. to a turbine portion of the turbo-charger 24.

Exhaust which rotates a turbine at the turbine portion of the turbo-charger 24 is discharged into a water muffler 60 through a first exhaust pipe 51, a back flow preventing chamber 52 for preventing flow-back of water (entrance of water into the turbo-charger 24 and the like) at the time of capsizing, and a second exhaust pipe 53 (forward exhaust-pipe), each of which is provided with a water jacket, and is further discharged from the water muffler 60 into the pump chamber 18, in which the jet pump 30 is arranged, through an exhaust/drainage pipe 54 (rearward exhaust-pipe) which opens (54*a*) out of the watercraft.

In this way, the exhaust pipes extending from the engine 20 (in this embodiment, the first exhaust pipe 51, the back flow preventing chamber 52, and the second exhaust pipe 53) are connected through the water muffler 60 to the pump chamber 18.

Therefore, the exhaust of the engine 20 is discharged, together with water passing the water jackets with which the exhaust pipes (in this embodiment, the first exhaust pipe 51, the back-flow preventing chamber 52 are provided, and the second exhaust pipe 53) are provided, into the water muffler 60 and is further discharged into the pump chamber 18 through the exhaust pipe (exhaust/drainage pipe) 54 and its exhaust outlet (exhaust/drainage outlet) 54*a*.

FIGS. 3(*a*), 3(*b*) and 3(*c*) are views illustrating an exhaust system, in which FIG. 3(*a*) is a plane view, FIG. 3(*b*) is a side view (a front view of FIG. 3(*a*)), and FIG. 3(*c*) is a partially abbreviated rear view.

Figure 4A:
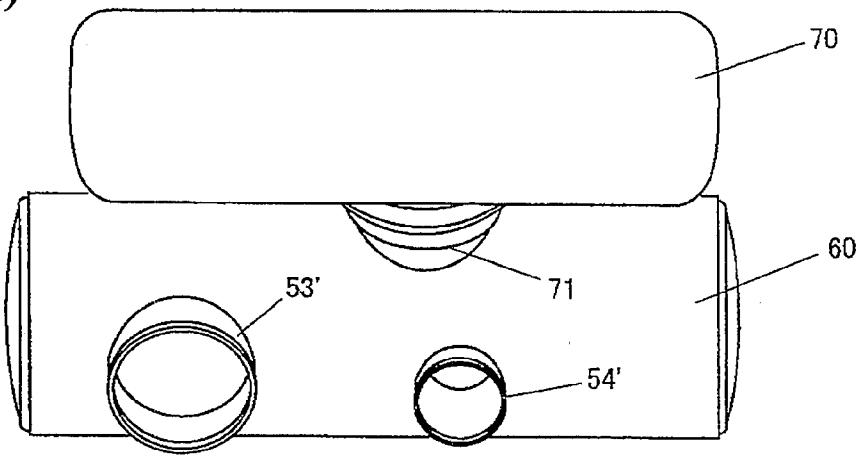
FIG. 4(*a*) is a view illustrating the water muffler 60 and the second resonator 70 in a plane view.
Figure 4B:
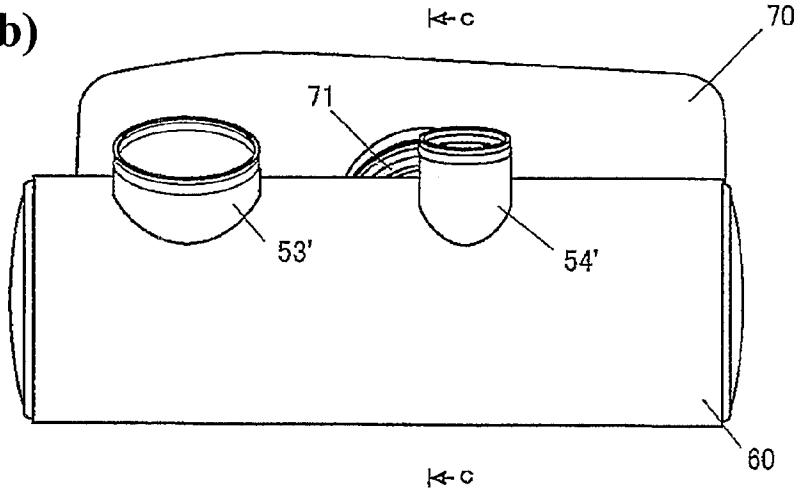
Figure 4C:
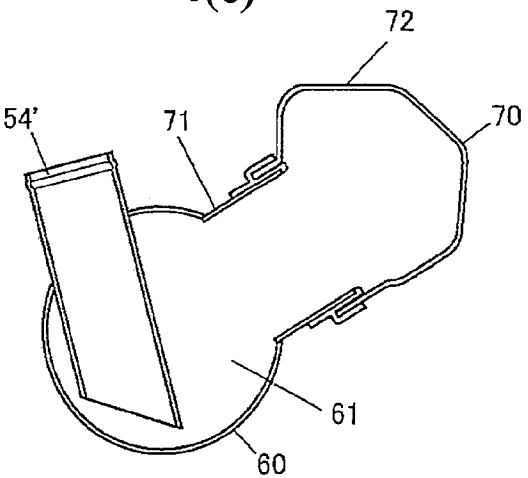

FIGS. 4(*a*), 4(*b*) and 4(*c*) are views illustrating the water muffler 60 and a second resonator 70, in which FIG. 4(*a*) is a plane view, FIG. 4(*b*) is a side view, and FIG. 4(*c*) is a sectional view taken along c-c line in FIG. 4(*b*).

Figures 5A, 5B:
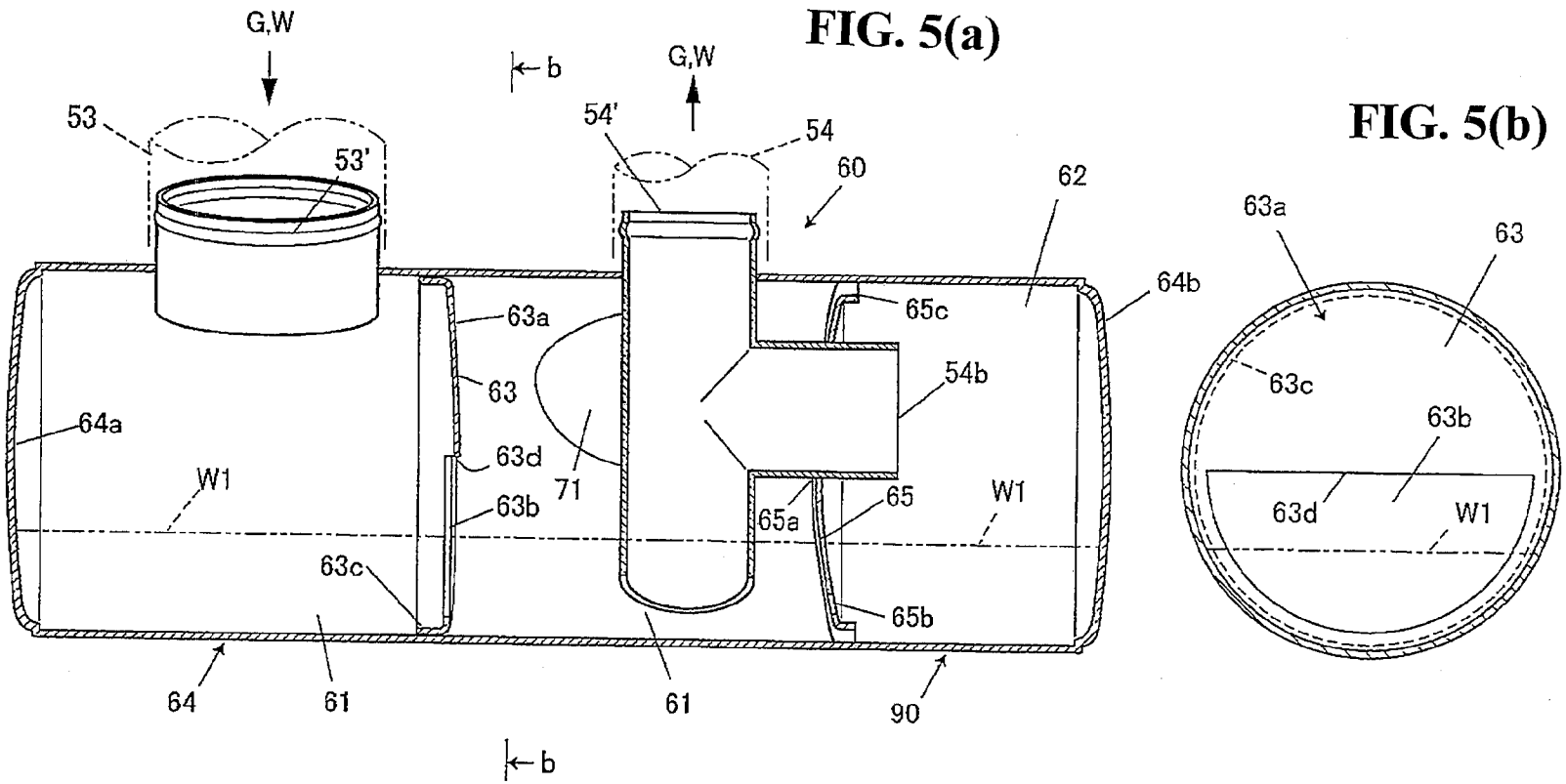
FIG. 5(*a*) is a view showing the water muffler 60 in a partially sectional view.

FIGS. 5(*a*) and 5(*b*) are views showing the water muffler 60, in which FIG. 5(*a*) is a partially sectional view and FIG. 5(*b*) is a partially abbreviated sectional view taken along b-b line in FIG. 5(*a*).

Figure 6A:
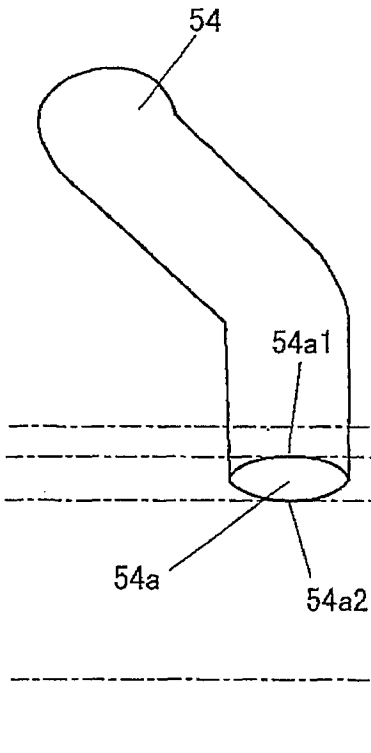
FIG. 6(*a*) is a view showing the relationship between the exhaust outlet and the waterlines in a rear view.
Figure 6B:
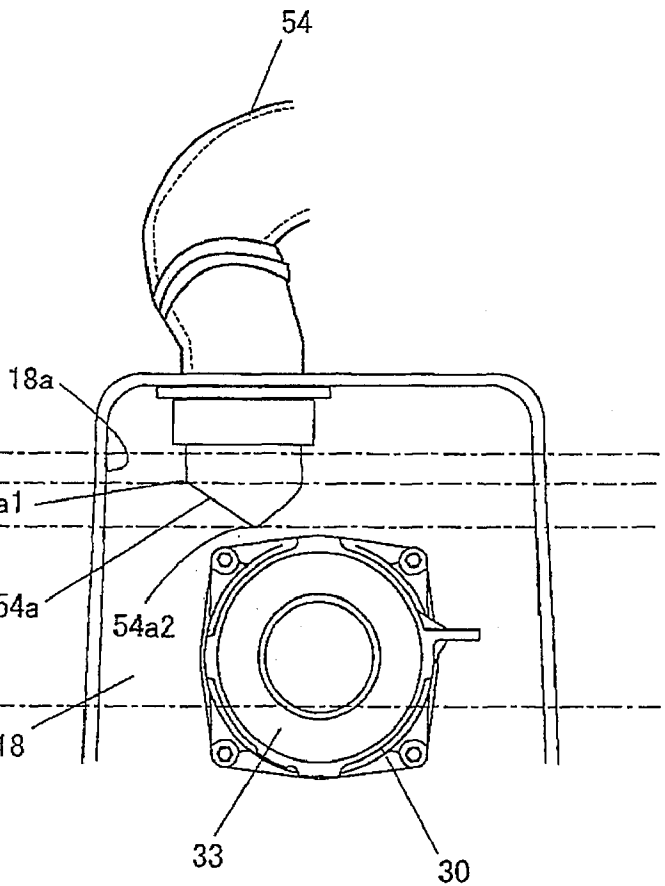

FIGS. 6(*a*) and 6(*b*) are views showing a relationship between the exhaust outlet and the waterline, in which FIG. 6(*a*) is a rear view and FIG. 6(*b*) is a partially abbreviated side view.

As shown in FIGS. 5(*a*) and 5(*b*), the interior of the water muffler 60 is divided into a single expansion chamber 61 and a resonator chamber 62. To the expansion chamber 61, the forward exhaust-pipe 53 is connected to the engine 20, and the rearward exhaust-pipe 54 opening out of the watercraft (refer to reference numeral 54*a* in FIG. 3(*c*) and FIGS. 6(*a*) and 6(*b*)) are connected.

The resonator chamber 62 is connected directly to a middle portion of the rearward exhaust-pipe 54 through a connection pipe 54*b*.

As discussed above, exhaust gas G and cooling water W are induced into the water muffler 60 from the forward exhaust-pipe 53 and discharged, through the rearward exhaust-pipe 54, out of the watercraft (pump chamber 18) from the water muffler 60. As shown in FIG. 3(*c*), the rearward exhaust-pipe 54 extends from the water muffler 60 upwardly is bent into a U-shape so as to extend downwardly, and penetrated through an upper wall of the pump chamber 18, whereby the exhaust outlet 54*a* opens into the pump chamber 18.

As shown in FIG. 5, the water muffler 60 has a water control plate 63 which is provided between the forward exhaust-pipe 53 opening into the expansion chamber 61, and the rearward exhaust-pipe 54 so as to be disposed on an upper side of the interior of the expansion chamber 61.

The resonator chamber 62 has a characteristic of a large attenuating amount in a low frequency region (200-300 Hz).

The water muffler 60 is configured such that a cylindrical body 64 is closed at forward and rearward portions thereof with discs 64*a*, 64*b*, and the water control plate 63 and a partition plate 65 dividing the resonator chamber 62 are provided in the interior of the cylindrical body 64.

To an upper portion of the cylindrical body 64, a connection pipe 53' is connected, by welding etc., in front of the water control plate 63, and a connection pipe 54' is connected, by welding etc., between the water control plate 63 and the partition plate 65.

To the connection pipe 53', the forward exhaust-pipe 53 is connected. The connection pipe 53' itself constitutes a part of the forward exhaust-pipe 53.

To the connection pipe 54', the rearward exhaust-pipe 54 is connected. The connection pipe 54' itself constitutes a part of the rearward exhaust-pipe 54. At the connection pipe 54', the connection pipe 54*b* which directly connects a middle portion of the connection pipe 54' and the resonator chamber 62 is integrally provided.

The water control plate 63 is formed by causing the substantially lower half of a disc 63*a* to be punched out in a half circle-shape as shown in FIG. 5(*b*), to thereby form an opening 63*b*, so that the upper half portion of the disc 63*a* constitutes the water control plate 63. The disc 63*a* is bent at a circumferential portion thereof by 90 degrees and fixed in the cylindrical body 64 by joining the bent portion 63*c* to an inner surface of the cylindrical body 64 by welding, etc.

The partition plate 65 is bent at a circumferential portion thereof by 90 degrees and fixed in the cylindrical body 64 by joining the bent portion 65*c* to the inner surface of the cylindrical body 64 by welding, etc. At the partition plate 65, a hole 65*a* through which the connection pipe 54 is penetrated and a water passage port 65*b* for returning water in the resonator chamber 62 to the expansion chamber 61 are provided.

In FIGS. 5(*a*) and 5(*b*), W1 designates the surface of water discharged together with exhaust into the water muffler 60 from the forward exhaust-pipe 53. A lower end 63*d* of the water control plate 63 (an upper end of the opening 63*b*) is located upward of the surface W1 of water. The connection pipe 54*b* is also located upward of the surface W1 of water. The water passage port 65*b* is located downward of the surface W1 of water.

As shown in FIG. 4, a second resonator chamber 70 serving as a resonator independent of the exhaust pipes is provided so as to be adjacent the water muffler 60. The second resonator chamber 70 is connected to the expansion chamber 61 of the water muffler 60 through a second connection pipe 71.

As shown in FIG. 4(*c*), the second connection pipe 71 and the second resonator chamber 70 are provided so as to face obliquely upwardly from the expansion chamber 61 in such a manner that water does not accumulate in the second connection pipe 71 and the second resonator chamber 70.

Therefore, even if water enters the second connection pipe 71 or the second resonator chamber 70, the water is returned to the expansion chamber 61 and discharged together with the exhaust gas G out of the watercraft through the rearward exhaust-pipe 54.

In order that the volume of the second resonator chamber 70 is effectively obtained, the second resonator chamber 70 is configured such that an upper surface (upper plate) 72 of the second resonator chamber 70 is parallel to an inner surface of the deck 15 as shown in FIG. 3(*c*).

As shown in FIGS. 2, 3(*a*) and 3(*b*) and discussed above, the water muffler 60 is formed into a cylindrical shape and arranged laterally along the pump chamber 18 with a longitudinal direction thereof being oriented in a forward/rearward direction. The second resonator chamber 70 is also formed into a cylindrical shape and arranged outward laterally along the water muffler 60 with a longitudinal direction thereof being oriented in the forward/rearward direction.

As shown in FIGS. 2, 3(*c*), and 6(*a*), the exhaust/drainage outlet 54*s* of the rearward exhaust-pipe 54 opens directly into the pump chamber 18 without via the resonator.

In FIGS. 3(*b*) and 3(*c*), 6(*a*) and 6(*b*), each of WL1, WL2, WL2', and WL3 denotes the waterline (more particularly, a location of the surface of water in the pump chamber 18).

WL1 is the waterline at the time of stoppage of the watercraft. WL2 is the waterline at the time that the watercraft 10 travels to thereby cause the watercraft body to begin floating and the speed of the watercraft determines the extent that it causes the exhaust/drainage outlet 54*a* of the rearward exhaust-pipe 54 to begin coming up from the surface of water.

WL2' is the waterline at the time that the travel speed of the watercraft 10 is further speeded up and becomes to the extent that it causes the exhaust/drainage outlet 54*a* of the rearward exhaust-pipe 54 to completely come up from the surface of water.

WL3 is the waterline at the time that the travel speed of the watercraft 10 is further speeded up and the watercraft is brought into a high-speed travel (planing travel) state.

As illustrated in FIGS. 6(*a*), 6(*b*) and 6(*c*), the exhaust/drainage outlet (exhaust outlet) 54*a* of the rearward exhaust-pipe (exhaust pipe) 54 is arranged at a position that allows it to sink in the water (allows it to be located in a position lower than the waterlines WL1 and WL2) at the time that the travel speed of the watercraft body 11 (i.e., the watercraft 10) is a predetermined speed or less. In addition, the exhaust/drainage outlet is arranged at a position that allows it to be out of the water (allows it to be located in a position upper than the waterlines WL2 to WL3) at the time that the travel speed of the watercraft body exceeds the predetermined speed.

In any case, the exhaust/drainage outlet 54*a* is arranged at a position that allows it to sink in the water at the time that the small watercraft 10 is at berth and operated in a slow speed condition (a condition corresponding to an idling state (a condition where the throttle lever 13*a* is completely returned), for example, 1,000 rpm or less)).

In this embodiment, the exhaust/drainage outlet 54*a* is arranged at a position that allows it to sink in the water (allows it to be located in a position lower than the waterlines WL1, WL2) at the time that the travel speed of the watercraft body is 2,000 rpm or less in number of revolutions of the engine 20, and that allows it to get out of the water (allows it to be located in a position above the waterline WL2) at the time that the travel speed of the watercraft body becomes a speed which exceeds 2,000 rpm in the number of revolutions of the engine 20.

The open surface of the exhaust outlet 54*a* is made oblique relative to the level surface (WL1, WL2, etc.).

In this embodiment, the exhaust outlet 54*a*, when viewed from the rear of the watercraft body (in FIG. 6(*a*)), is provided so as to be offset toward a side wall surface 18*a* of the pump chamber 18 from a center of the jet pump 30 in the pump chamber 18, and the open surface (54*a*) of the exhaust outlet 54*a* is made oblique toward the side wall surface 18*a* toward which the exhaust outlet 54*a* is offset.

The open surface (54*a*) of the exhaust outlet 54*a* is made oblique with respect to the level surface (WL1, etc.), so that when the travel speed of the watercraft body reaches approximately 2,000 rpm in number of revolutions of the engine 20, the exhaust outlet (its open surface) 54*a* begins getting at an upper region 54*a*1 thereof out of the surface of water WL2, and when the speed is speeded up (the speed becomes to the extent that it is substantially 3,000 rpm in the number of revolutions of the engine 20), the exhaust outlet (its open surface) 54*a* is at a lower region 54*a*2 thereof out of the surface of water WL2'.

More specifically, the open surface (54*a*) of the exhaust outlet 54*a* is oblique with respect to the level surface. Consequently, the exhaust/drainage outlet 54*a* gradually is out of the surface of water as the travel speed of the small watercraft 10 is speeded up.

Therefore, for example, when the speed of the small watercraft 10 becomes to the extent that it is 2,500 rpm in the number of revolutions of the engine 20, the exhaust/drainage outlet 54*a* is brought into a condition where about the lower half thereof sinks into the water and about the upper half thereof gets out of the water.

According to the exhaust system for the small watercraft, which is constructed as discussed above, when the number of revolutions of an engine in a small watercraft is low, exhaust noise is unpleasant for the passengers of the small watercraft.

According to this embodiment, exhaust noise in the low frequency region is reduced by the resonator chamber 70 independent of the exhaust pipes and, at the same time, the muffling effect is obtained since the exhaust outlet 54*a* of the exhaust pipe extending from the engine 20 provided in the watercraft body 11 sinks into the water when the travel speed of the watercraft body 11 is the predetermined speed or less (namely, at the time that the number of revolutions of the engine 20 is low).

Therefore, according to this embodiment, unpleasant exhaust noise in the low frequency region can be effectively reduced by the synergistic effect of the effect of reduction in exhaust noise in the low frequency region by the resonator chamber 70 and the muffling effect obtained by the sinking of the exhaust outlet 54*a* of the exhaust pipe into the water.

In any case, the exhaust/drainage outlet 54*a* is arranged at the position that allows it to sink in the water at the time that the small watercraft 10 is at berth and operated in the slow speed condition, whereby exhaust noise in the low frequency region at the time that the watercraft 10 is at berth and operated in the slow speed condition can be effectively reduced.

On the other hand, when the travel speed of the watercraft body 11 exceeds the predetermined speed, the exhaust outlet 54*a* of the exhaust pipe gets out of the water.

Thereby, exhaust resistance due to the sinking of the exhaust outlet 54*a* into the water vanishes and a condition where high output of the engine 20 is easy to be obtained is brought about.

As discussed above, according to this embodiment, the exhaust noise can be effectively reduced and, at the same time, the high output of the engine becomes easy to be obtained at the time of high speed traveling.

More particularly, the exhaust outlet 54*a* of the exhaust pipe is arranged at the position that allows it to sink in the water at the time that the travel speed of the watercraft body is 2,000 rpm or less in the number of revolutions of the engine 20, and that allows it to get out of the water at the time that the travel speed of the watercraft body 11 becomes the speed which exceeds 2,000 rpm in number of revolutions of the engine 20, whereby the most unpleasant exhaust noise at the time that the number of revolutions of the engine is 2,000 rpm or less can be effectively reduced and, at the same time, the high output of the engine at the time of the high speed traveling at the time that the number of revolutions of the engine exceeds 2,000 rpm becomes easy to be obtained.

In addition, the exhaust outlet 54*a* opens directly, without going via the resonator, into the pump chamber 18, provided in the watercraft body, in which the jet pump 30 driven by the engine 20 is arranged, so that the above-mentioned operation and effect discussed above become further positively obtained.

More specifically, the pump chamber 18 in which the jet pump 30 is arranged is easy to be stable relative to the water level (hard to be affected by wind and waves at the time of the operation of the watercraft body), as compared to other sections of the watercraft body 11 (for example, the side surfaces and rear surface of the watercraft body 11).

Therefore, by causing the exhaust outlet 54*a* to be located in the pump chamber 18, the above-mentioned operation and effect as discussed above becomes further positively obtained.

Further, the open surface (54*a*) of the exhaust outlet is made oblique with respect to the level surface, so that sudden movement of the entire open surface (54*a*) of the exhaust outlet out of the water and sudden sinking of the entire open surface into the water can be mitigated.

If the open surface of the exhaust outlet is made parallel to the level surface, the entire open surface of the exhaust outlet suddenly gets out of the water and suddenly sinks into the water.

Contrary to this, according to this embodiment, the open surface (54*a*) of the exhaust outlet is made oblique with respect to the level surface, so that the sudden movement of the entire open surface (54*a*) of the exhaust outlet out of the water or the sudden sinking of the entire open surface (54*a*) of the exhaust outlet into the water can be mitigated.

As discussed above, the exhaust/drainage outlet 54*a* gradually is out of the surface of water as the travel speed of the small watercraft 10 is speeded up.

Moreover, even if the water level with respect to the open surface (54*a*) of the exhaust outlet is changed because of the influence of waves, etc., the sudden movement of the entire open surface (54*a*) of the exhaust outlet out of the water, or the sudden sinking of the open surface (54*a*) of the exhaust outlet into the water can be also mitigated.

Therefore, sudden change of the exhaust noise and output of the engine can be mitigated.

Still further, the exhaust outlet 54*a* when viewed from the rear of the watercraft body is provided so as to be offset toward the side wall surface 18*a* of the pump chamber 18 from the center of the jet pump 30 in the pump chamber 18 and the open surface of the exhaust outlet 54*a* is made oblique toward the side wall surface 18*a* toward which the open surface of the exhaust outlet 54*a* is offset, so that the exhaust gas G mixed with the water from the exhaust outlet 54 can be smoothly discharged along the side wall 18*a* of the pump chamber 18.

In addition, the water muffler 60 is provided at the midway of the exhaust pipe extending from the engine 20 provided in the watercraft body, the interior of the water muffler 60 is divided into the expansion chamber 61 and the resonator chamber 62, and the forward exhaust-pipe 53 connected to the engine 20 and the rearward exhaust-pipe 54 opening out of the watercraft body are connected to the expansion chamber 61, so that it is possible to realize a reduction in the dimensions of the exhaust system.

The resonator chamber 62 is connected directly to the middle portion of the rearward exhaust-pipe 54 through the connection pipe 54*b*, whereby the function of the resonator chamber 62 as a resonator with respect to the rearward exhaust-pipe 54 is directly and sufficiently obtained.

Therefore, according to the exhaust system for the small watercraft, even if any resonator is not provided in the exhaust/drainage outlet 54*a* as in the past, sufficient reduction in exhaust noise becomes possible in cooperation with the above-mentioned operation and effect.

In addition, the second resonator chamber 70 is provided so as to be adjacent the water muffler 60 and is connected to the expansion chamber 61 through the second connection pipe 71, thus making it possible to considerably reduce low frequency noise that is especially unpleasant.

Meanwhile, in the case where the second resonator chamber 70 is provided, if as in this embodiment, the interior of the water muffler 60 is divided into the expansion chamber 61 and the resonator chamber 62 (namely, the expansion chamber 61 and the resonator chamber 62 are integrated with each other in the water muffler 60) and the resonator chamber 62 is connected directly to the middle portion of the rearward exhaust-pipe 54 through the connection pipe 54*b*, a problem is raised in which the second resonator is provided with respect to the water muffler in what manner.

In connection with this, according to this embodiment, the water muffler 60 is formed into a cylindrical shape and is arranged laterally along the pump chamber 18, in which the jet pump driven by the engine 20 is arranged, with the longitudinal direction thereof being oriented in the forward/rearward direction, and the second resonator 70 is arranged outwardly laterally along the water muffler 60, whereby the above-mentioned problem is solved and a dead space which is easy to be produced outwardly and laterally of the water muffler 60 in the watercraft body can be advantageously used.

While the present invention is discussed above with reference to the embodiment of the present invention, the present invention is not limited to the embodiment, and modifications and variations can be suitably made to the embodiment within the scope of the spirit of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust system for a small watercraft, comprising:

a water muffler arranged on one side of a pump chamber;

an exhaust pipe adapted to extend from an engine and connected through the water muffler to the pump chamber; and an exhaust pipe extending upwardly from the water muffler, said exhaust pipe being bent into a U-shape so as to extend downwardly, and penetrate through an upper wall of the pump chamber wherein an exhaust outlet thereof opens into the pump chamber; and a resonator being provided independent of the exhaust pipe, said resonator being connected to the water muffler;

wherein the exhaust outlet of the exhaust pipe is disposed at a position wherein the exhaust outlet sinks into water at the time when a travel speed of the watercraft body is a predetermined speed or less, and the exhaust outlet is raised above the water at the time when the travel speed of the watercraft exceeds the predetermined speed and the exhaust outlet, as viewed from a rear of the watercraft body, is provided so as to be offset toward a side wall surface of the pump chamber from a center of a jet pump in the pump chamber, and an open surface of the exhaust outlet is made oblique toward the side wall surface toward which the exhaust outlet is offset.

2. The exhaust system for a small watercraft according to claim 1, wherein the small watercraft includes the exhaust system with the exhaust pipe extending from the engine and having the exhaust outlet disposed in a position that allows the exhaust outlet to sink in the water at the time when a travel speed of the watercraft body is 2,000 rpm or less in a number of revolutions of the engine, and that allows the exhaust outlet to get out of the water at the time when the travel speed of the watercraft body becomes a speed which exceeds 2,000 rpm in the number of revolutions of the engine.

3. The exhaust system for the small watercraft according to claim 1, wherein the exhaust outlet opens directly into the pump chamber without going via the resonator.

4. The exhaust system for the small watercraft according to claim 1, wherein an open surface of the exhaust outlet is made oblique with respect to a level surface.

5. An exhaust system for a small watercraft, comprising:

a water muffler arranged on one side of a pump chamber;

an exhaust pipe adapted to extend from an engine and connected through the water muffler to the pump chamber; and an exhaust pipe extending upwardly from the water muffler, said exhaust pipe being bent into a U-shape so as to extend downwardly, and penetrate through an upper wall of the pump chamber wherein an exhaust outlet thereof opens into the pump chamber; and a resonator being provided independent of the exhaust pipe, said resonator being connected to the water muffler;

wherein the exhaust outlet of the exhaust pipe is disposed at a position wherein the exhaust outlet sinks into water at the time when a travel speed of the watercraft body is a predetermined speed or less, and the exhaust outlet is raised above the water at the time when the travel speed of the watercraft exceeds the predetermined speed, wherein the small watercraft includes the exhaust system with the exhaust pipe extending from the engine and having the exhaust outlet disposed in a position that allows the exhaust outlet to sink in the water at the time when a travel speed of the watercraft body is 2,000 rpm or less in a number of revolutions of the engine, and that allows the exhaust outlet to get out of the water at the time when the travel speed of the watercraft body becomes a speed which exceeds 2,000 rpm in the number of revolutions of the engine.

6. The exhaust system for the small watercraft according to claim 5, wherein the exhaust outlet opens directly into the pump chamber without going via the resonator.

7. The exhaust system for the small watercraft according to claim 5, wherein an open surface of the exhaust outlet is made oblique with respect to a level surface.

8. The exhaust system for the small watercraft according to claim 5, wherein the exhaust outlet, as viewed from a rear of the watercraft body, is provided so as to be offset toward a side wall surface of the pump chamber from a center of a jet pump in the pump chamber, and an open surface of the exhaust outlet is made oblique toward the side wall surface toward which the exhaust outlet is offset.

9. The exhaust system for the small watercraft according to claim 5, wherein the water muffler is formed into a cylindrical shape and arranged laterally along the pump chamber, with a longitudinal direction thereof being oriented in a forward/rearward direction, and the resonator is formed into a cylindrical shape and arranged outwardly and laterally along the water muffler.

* * * * *